US007226148B2

(12) United States Patent
Song et al.

(10) Patent No.: US 7,226,148 B2
(45) Date of Patent: Jun. 5, 2007

(54) INK-JET PRINTHEAD AND METHOD OF MANUFACTURING THE SAME

(75) Inventors: Hoon Song, Seoul (KR); Yong-soo Oh, Seongnam-si (KR); Jong-woo Shin, Seoul (KR); Hyung-taek Lim, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 233 days.

(21) Appl. No.: 10/899,109

(22) Filed: Jul. 27, 2004

(65) Prior Publication Data

US 2005/0024441 A1 Feb. 3, 2005

(30) Foreign Application Priority Data

Jul. 29, 2003 (KR) ..... 10-2003-0052439

(51) Int. Cl.
*B41J 2/05* (2006.01)

(52) U.S. Cl. ..... 347/56; 347/58; 347/63

(58) Field of Classification Search ..... 347/56, 347/58, 63

See application file for complete search history.

(56) References Cited

U.S. PATENT DOCUMENTS

| | | | | |
|---|---|---|---|---|
| 4,882,595 | A | 11/1989 | Trueba et al. | 346/140 |
| 6,019,457 | A | 2/2000 | Silverbrook | |
| 6,299,786 | B1 | 10/2001 | Silverbrook | |
| 6,499,832 | B2 | 12/2002 | Lee et al. | 347/56 |
| 6,561,626 | B1 * | 5/2003 | Min et al. | 347/47 |
| 2004/0109043 | A1 * | 6/2004 | Song et al. | 347/63 |
| 2004/0183865 | A1 | 9/2004 | Hu et al. | |

FOREIGN PATENT DOCUMENTS

| | | |
|---|---|---|
| EP | 1 215 048 A2 | 6/2002 |
| EP | 1 215 048 A3 | 6/2002 |
| EP | 1 216 835 A2 | 6/2002 |
| EP | 1 216 835 A3 | 6/2002 |
| TW | 552 200 B | 9/2003 |

* cited by examiner

*Primary Examiner*—Stephen Meier
*Assistant Examiner*—Han Samuel Choi
(74) *Attorney, Agent, or Firm*—Lee & Morse, P.C.

(57) ABSTRACT

An ink-jet printhead, and a method of manufacturing the same, includes a substrate, an ink chamber, a manifold, and an ink channel formed between the ink chamber and the manifold to provide flow communication between the ink chamber and the manifold, a substantially flat nozzle plate formed on the upper surface of the substrate, the nozzle plate including a plurality of passivation layers, a heat dissipation layer disposed on the plurality of passivation layers, the heat dissipation layer formed of a thermally conductive material and including a first thermally conductive layer formed on the plurality of passivation layers and a second thermally conductive layer formed on the first thermally conductive layer, and a nozzle extending through the nozzle plate in flow communication with the ink chamber, and a heater and a conductor, the heater heating ink filled in the ink chamber and the conductor applying current to the heater.

14 Claims, 15 Drawing Sheets

INK-JET PRINTHEAD AND METHOD OF MANUFACTURING THE SAME

BACKGROUND OF THE INVENTION

1. Field of the Invention

The present invention relates to an ink-jet printhead and a method of manufacturing the same. More particularly, the present invention relates to an ink-jet printhead and a method of manufacturing the same that is able to obtain a substantially flat nozzle plate, thereby extending a lifespan of the printhead.

2. Description of the Related Art

In general, ink-jet printheads are devices for printing a predetermined image, color or black, by ejecting a small volume droplet of ink at a desired position on a recording sheet. Ink-jet printheads are generally categorized into two types depending on which ink ejection mechanism is used. A first type is a thermal ink-jet printhead, in which a heat source is employed to form and expand a bubble in ink to cause an ink droplet to be ejected due to an expansive force of the formed bubble. A second type is a piezoelectric ink-jet printhead, in which an ink droplet is ejected by a pressure applied to the ink due to a deformation of a piezoelectric element.

An ink droplet ejection mechanism of a thermal ink-jet printhead will now be explained in detail. When a current pulse is supplied to a heater, which includes a heating resistor, the heater generates heat and ink near the heater is instantaneously heated to approximately 300° C., thereby boiling the ink. The boiling of the ink causes bubbles to be generated, expand and exert pressure on the ink filling an ink chamber. As a result, ink around a nozzle is ejected from the ink chamber in droplet form through the nozzle.

A thermal ink-jet printhead is classified into a top-shooting type, a side-shooting type, and a back-shooting type, depending on a growth direction of a bubble and an ejection direction of an ink droplet. In a top-shooting type printhead, a bubble grows in the same direction in which an ink droplet is ejected. In a side-shooting type of printhead, a bubble grows in a direction perpendicular to a direction in which an ink droplet is ejected. In a back-shooting type of printhead, a bubble grows in a direction opposite to a direction in which an ink droplet is ejected.

An ink-jet printhead using the thermal driving method should satisfy the following requirements. First, manufacturing of the ink-jet printheads should be simple, costs should be low, and should facilitate mass production thereof. Second, in order to obtain a high-quality image, cross talk between adjacent nozzles should be suppressed while a distance between adjacent nozzles should be narrow; that is, in order to increase dots per inch (DPI), a plurality of nozzles should be densely positioned. Third, in order to perform a high-speed printing operation, a period in which the ink chamber is refilled with ink after being ejected from the ink chamber should be as short as possible and the cooling of heated ink and heater should be performed quickly to increase a driving frequency.

FIG. 1A illustrates an exploded perspective view of a conventional thermal ink-jet printhead. FIG. 1B illustrates a cross-sectional view for explaining a process of ejecting an ink droplet in the conventional thermal ink-jet printhead of FIG. 1A.

Referring to FIGS. 1A and 1B, the conventional thermal ink-jet printhead includes a substrate 10, an ink chamber 26, which is formed on the substrate 10 and stores ink therein, partition walls 14, which define the ink chamber 26, a heater 12, which is disposed within the ink chamber 26, a nozzle 16, through which an ink droplet 29' is ejected, and a nozzle plate 18, through which the nozzle 16 is formed. In operation, a current pulse is supplied to the heater 12 to generate heat, such that ink 29 filled in the ink chamber 26 is heated, thereby generating a bubble 28. The generated bubble 28 continuously expands such that a pressure is applied to the ink 29 filled in the ink chamber 26, thereby ejecting the ink droplet 29' out of the printhead through the nozzle 16. Subsequently, ink 29 from a manifold 22 is introduced into the ink chamber 26 through an ink channel 24. Resultantly, the ink chamber 26 is refilled with ink 29.

To manufacture the conventional top-shooting type ink-jet printhead constructed as above, the nozzle plate 18, in which the nozzle 16 is formed, is required to be separately manufactured from the substrate 10, on which the ink chamber 26 and the ink channel 24 are formed. Subsequently, the nozzle plate 18 and the substrate 10 are required to be bonded together. Thus, the manufacturing process is complicated and misalignment may occur during the step of bonding the nozzle plate 18 to the substrate 10. In addition, when the nozzle plate 18 is bonded to the substrate 10, it is very difficult to ensure that bonded portions therebetween have a uniform thickness. In addition, because the ink chamber 26, the ink channel 24, and the manifold 22 are disposed on a same level, an increase in the number of nozzles 16 per unit area, i.e., nozzle density, is limited. As a result, it is difficult to realize an ink-jet printhead having high printing speed and high resolution.

To solve the problems of the conventional ink-jet printhead, various types of ink-jet printheads have been suggested recently. One example of an attempt to solve these problems is a conventional monolithic ink-jet printhead shown in FIG. 2.

Referring to FIG. 2, a hemispherical ink chamber 32 is formed in an upper portion of a silicon substrate 30, and a manifold 36 is formed in a lower portion of the substrate 30. An ink channel 34 passes through the ink chamber 32 and is interposed between the ink chamber 32 and the manifold 36 to provide flow communication between the ink chamber 32 and the manifold 36. A plurality of material layers 41, 42, and 43 are stacked on the substrate 30 to form a nozzle plate 40. The nozzle plate 40 is integrally formed with the substrate 30. A nozzle 47 is formed in the nozzle plate 40 at a position corresponding to a central portion of the ink chamber 32. A heater 45 is disposed around the nozzle 47 and is connected to a conductor 46. A nozzle guide 44 is formed along an outer peripheral surface of the nozzle 47 and extends toward the ink chamber 32. Heat generated by the heater 45 is transmitted to ink 48 filled in the ink chamber 32 through an insulating layer, i.e., the lowest material layer, 41. Accordingly, the ink 48 is boiled to generate bubbles 49. The generated bubbles 49 are expanded to exert a pressure on the ink 48 filled in the ink chamber 32. Therefore, the ink 48 is ejected in the form of a droplet 48' through the nozzle 47. Subsequently, ink 48 is introduced through the ink channel 34 from the manifold 36 to refill the ink chamber 32 with ink 48.

In this conventional ink-jet printhead constructed as above, since the silicon substrate 30 is integrally formed with the nozzle plate 40, the manufacturing process is simplified and misalignment may be avoided. Furthermore, since the nozzle 47, the ink channel 34, and the manifold 36 are vertically arranged, the conventional ink-jet printhead of FIG. 2 may achieve higher nozzle density than the conventional ink-jet printhead of FIGS. 1A and 1B.

However, in the conventional ink-jet printhead shown in FIG. 2, the material layers 41, 42, and 43, which are formed around the heater 45, are made of a material having a low thermal conductivity, such as oxide or nitride, to provide electrical insulation. Accordingly, it requires a significant amount of time to sufficiently cool the heater 45, which has generated heat to eject the ink 48, the ink 48 filled in the ink chamber 32, and the nozzle guide 44 to initial states thereof, thereby failing to sufficiently increase an operating frequency.

The material layers 41, 42, and 43 constituting the nozzle plate 40 in this conventional ink-jet printhead are formed using chemical vapor deposition (CVD). It is difficult to form thick material layers using CVD. As a result, since the nozzle plate 40 has a relatively small thickness of approximately 5 μm, the nozzle 47 cannot be long enough to adequately eject the ink droplet 48'. If the nozzle 47 is short, the linearity of the ejected ink droplet 48' decreases. Further, since it is possible that a meniscus of the ink 48 does not remain in the nozzle 47, but penetrates into the ink chamber 32 after the ink droplet 48' is ejected, a stable high speed printing operation cannot be ensured. While the nozzle guide 44 is formed along the outer peripheral surface of the nozzle 47 in an effort to solve these problems, if the nozzle guide 44 is too long, it complicates formation of the ink chamber 32 by etching the substrate 30 and limits the expansion of the bubbles 49. Because of the nozzle guide 44, there is a limitation in achieving a nozzle having a sufficient length.

Additionally, an outlet of the nozzle 47 in the conventional ink-jet printhead does not have a sharp edge but a round edge, which becomes wider toward the outside of the printhead. Hence, the ejection characteristics of the ink droplet 48' decrease and an outer surface of the nozzle plate 40 is easily wet with the ink 48.

SUMMARY OF THE INVENTION

The present invention is therefore directed to a thermal monolithic ink-jet printhead and a method of manufacturing the same, which substantially overcome one or more of the problems due to the limitations and disadvantages of the related art.

It is a feature of an embodiment of the present invention to provide a thermal monolithic ink-jet printhead and a method of manufacturing the same that is able to obtain a substantially flat nozzle plate, thereby extending a lifespan of the printhead.

At least one of the above features and other advantages may be provided by an ink-jet printhead including a substrate, an ink chamber to be filled with ink to be ejected formed on an upper surface of the substrate, a manifold for supplying ink to the ink chamber formed on a lower surface of the substrate, and an ink channel formed between the ink chamber and the manifold to provide flow communication between the ink chamber and the manifold, a substantially flat nozzle plate formed on the upper surface of the substrate, the nozzle plate including a plurality of passivation layers, a heat dissipation layer disposed on the plurality of passivation layers, the heat dissipation layer formed of a thermally conductive material and including a first thermally conductive layer formed on the plurality of passivation layers and a second thermally conductive layer formed on the first thermally conductive layer, and a nozzle extending through the nozzle plate in flow communication with the ink chamber, and a heater and a conductor, each of which is interposed between adjacent passivation layers of the nozzle plate, the heater heating ink filled in the ink chamber and the conductor applying current to the heater.

The first thermally conductive layer may include copper (Cu). The first thermally conductive layer may have a substantially flat top surface, and may have a thickness ranging from about 1 to 12 μm. A thickness of the first thermally conductive layer may be less than a thickness of the second thermally conductive layer.

The second thermally conductive layer may be of a material selected from the group consisting of nickel (Ni), copper (Cu), aluminum (Al), and gold (Au).

An anti-corrosion layer may be formed over the heat dissipation layer to prevent the heat dissipation layer from being corroded by ink, and may be made of a material selected from the group consisting of gold (Au), platinum (Pt), and palladium (Pd). The anti-corrosion layer may have a thickness ranging from about 0.1 to 1 μm.

A seed layer may be formed between the plurality of passivation layers and the first thermally conductive layer to be used in plating the first thermally conductive layer, and may be made of a material selected from the group consisting of copper (Cu), chromium (Cr), titanium (Ti), gold (Au), and nickel (Ni).

The plurality of passivation layers may include a first passivation layer, a second passivation layer, and a third passivation layer, which are sequentially stacked on the substrate, the heater may be interposed between the first passivation layer and the second passivation layer, and the conductor may be interposed between the second passivation layer and the third passivation layer.

A lower portion of the nozzle may be formed in the plurality of passivation layers and an upper portion of the nozzle may be formed in the heat dissipation layer. The upper portion of the nozzle formed in the heat dissipation layer may have a tapered shape having a sectional area that decreases toward an outlet of the nozzle.

At least one of the above features and other advantages may be provided by a method of manufacturing an ink-jet printhead including sequentially forming a plurality of passivation layers on a substrate and forming a heater and a conductor, which is connected to the heater, between adjacent passivation layers, forming a first thermally conductive layer having a substantially flat top surface on the plurality of passivation layers, forming a second thermally conductive layer on the first thermally conductive layer, and forming a nozzle so that the nozzle extends through the second thermally conductive layer, the first thermally conductive layer, and the plurality of passivation layers to eject ink therethrough, etching a lower surface of the substrate to form a manifold and an ink channel, and etching an upper surface of the substrate, which is exposed through the nozzle, to form an ink chamber in flow communication with the ink channel.

Forming the first and second thermally conductive layers and the nozzle may include etching the plurality of passivation layers to form a lower nozzle; forming a plating mold having a predetermined shape in a vertical direction from the lower nozzle to define an upper nozzle; forming the first thermally conductive layer on the plurality of passivation layers at both sides of the plating mold, the first thermally conductive layer having the substantially flat top surface; forming the second thermally conductive layer on the first thermally conductive layer; and removing the plating mold to form the nozzle including the upper nozzle and the lower nozzle.

The first thermally conductive layer may be formed using a copper damascening process, and may have a thickness ranging from about 1 to 12 μm.

The method may further include forming a seed layer over the plurality of passivation layers to be used in plating the first thermally conductive layer, before forming the plating mold. The seed layer may be formed by sputtering a material selected from the group consisting of copper (Cu), chromium (Cr), titanium (Ti), gold (Au), and nickel (Ni).

The second thermally conductive layer may be formed by electrolytically plating a material, which is selected from the group consisting of nickel (Ni), copper (Cu), aluminum (Al), and gold (Au), on the first thermally conductive layer.

The method may further include forming an anti-corrosion layer over the first thermally conductive layer and the second thermally conductive layer exposed to the outside, after the nozzle forming step. The anti-corrosion layer may be formed using an electroless plating process, may be made of a material selected from the group consisting of gold (Au), platinum (Pt), and palladium (Pd), and may have a thickness ranging from about 0.1 to 1 μm.

An upper portion of the plating mold may have a tapered shape having a diameter that decreases upward toward an outlet of the nozzle.

Forming the passivation layers, the heater and the conductor may include forming a first passivation layer on the substrate; forming the heater on the first passivation layer; forming a second passivation layer on the first passivation layer and the heater; forming the conductor on the second passivation layer; and forming a third passivation layer on the second passivation layer and the conductor.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1A:
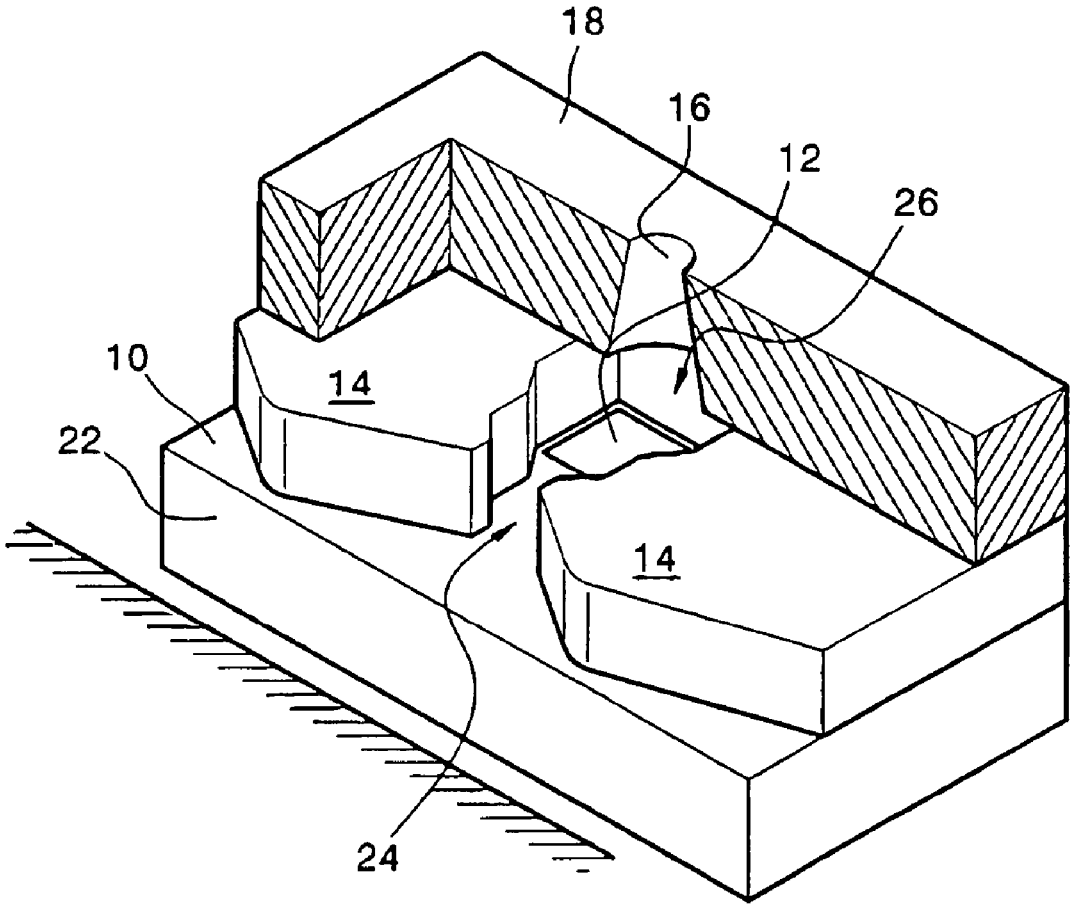
FIG. 1A (PRIOR ART)
FIG. 1A illustrates an exploded perspective view of a conventional thermal ink-jet printhead.
Figure 1B:
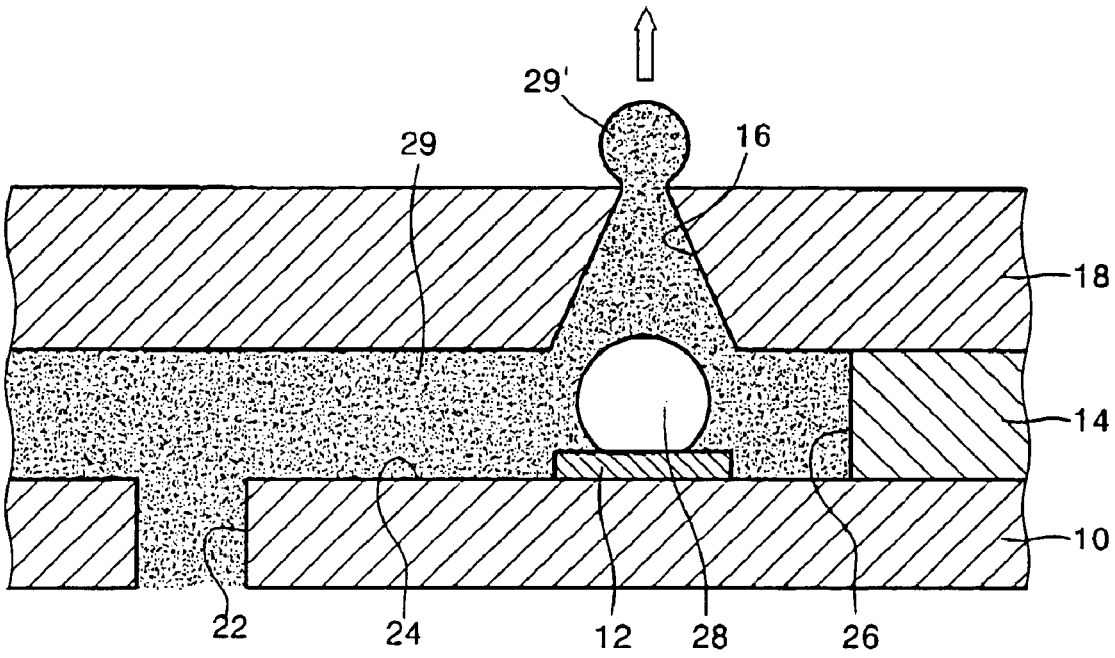
FIG. 1B (PRIOR ART)
FIG. 1B illustrates a cross-sectional view for explaining a process of ejecting an ink droplet from the conventional thermal ink-jet printhead of FIG. 1A.
Figure 2:
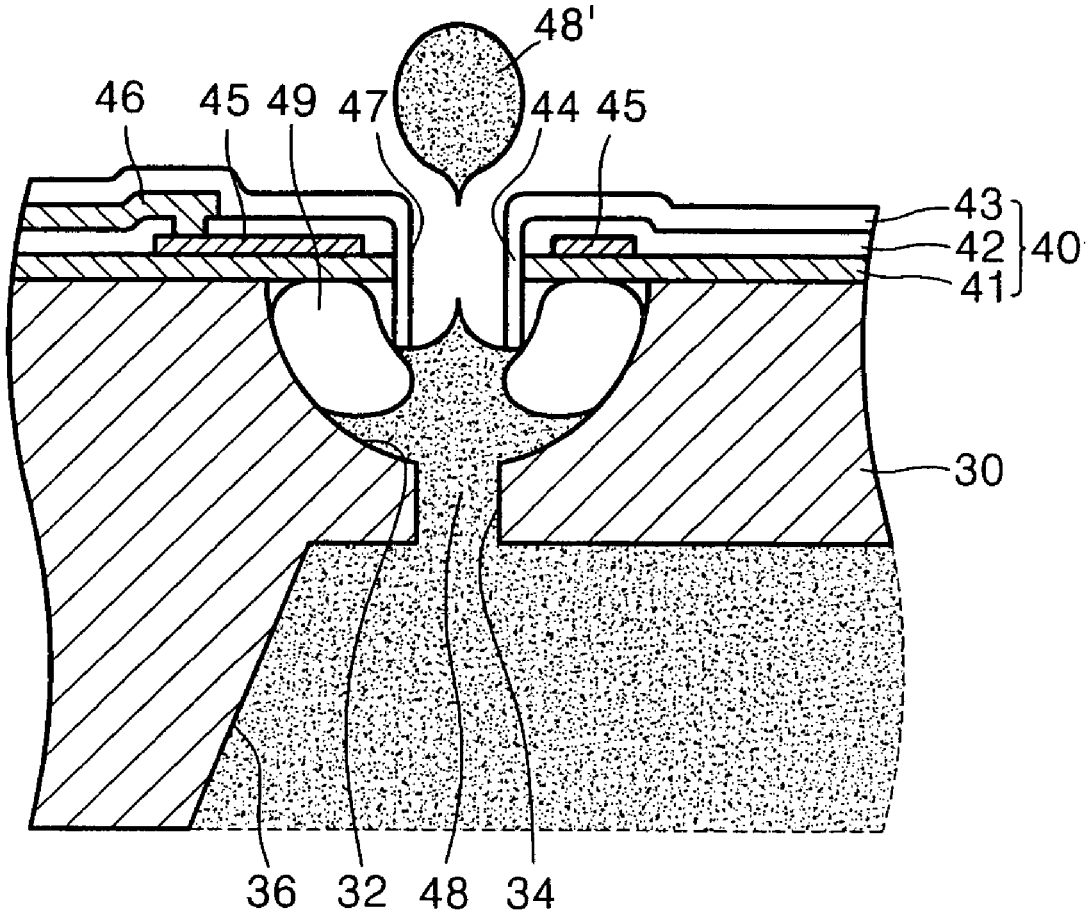
FIG. 2 (PRIOR ART)
FIG. 2 illustrates a cross-sectional view of a conventional monolithic ink-jet printhead.

Korean Patent Application No. 2003-52439, filed on Jul. 29, 2003, in the Korean Intellectual Property Office, and entitled: "Ink-Jet Printhead and Method of Manufacturing the Same," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 3:
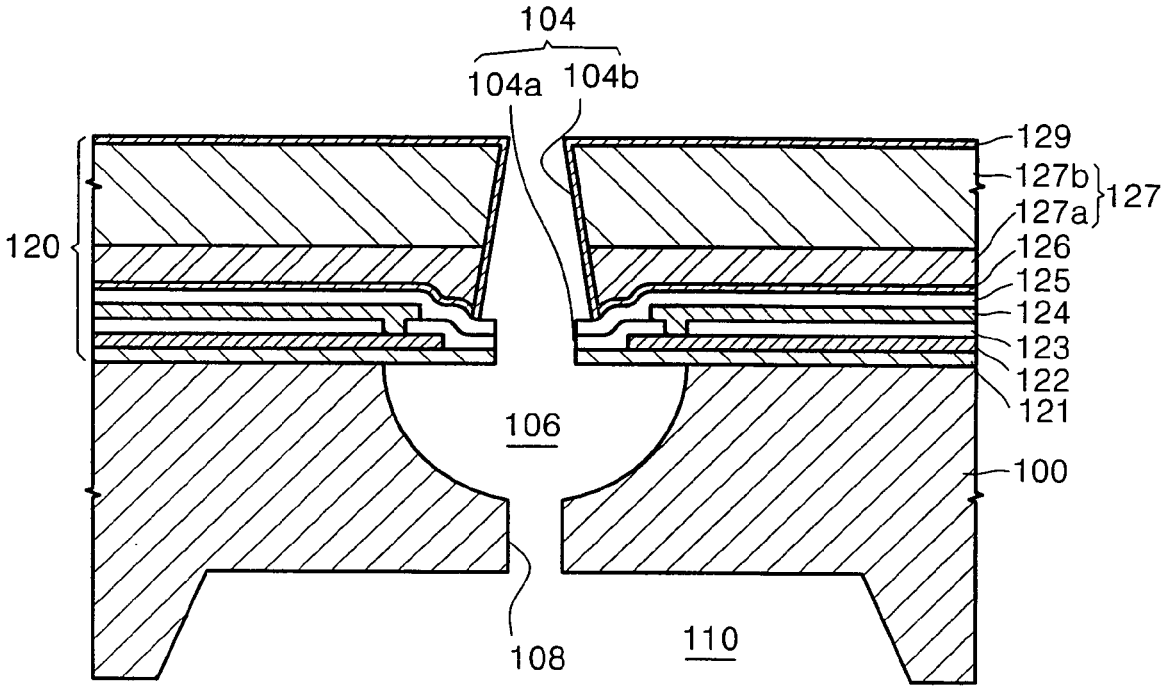
FIG. 3 illustrates a cross-sectional view of a monolithic ink-jet printhead according to an embodiment of the present invention.

FIG. 3 illustrates a cross-sectional view of an ink-jet printhead according to an embodiment of the present invention.

Referring to FIG. 3, the ink-jet printhead includes a substrate 100 and a nozzle plate 120, which is formed on the substrate 100.

An ink chamber 106 is formed on an upper surface of the substrate 100 to be filled with ink. A manifold 110 is formed on a lower surface of the substrate 100 to supply ink to the ink chamber 106. An ink channel 108 is formed between the ink chamber 106 and the manifold 110 to supply ink from the manifold 110 to the ink chamber 106. The manifold 110 is in flow communication with an ink container (not shown) in which ink is stored.

The ink chamber 106 is formed by isotropically etching the upper surface of the substrate 100 to have a substantially hemispherical shape as shown in FIG. 3. The ink channel 108 may be formed in a cylindrical shape and vertically extends through a portion of the substrate 100 between the ink chamber 106 and the manifold 110. The ink chamber 106 and the ink channel 108 may have various shapes according to the etched shape of the substrate 100. Therefore, the ink chamber 106 may have a rectangular shape of a predetermined depth, and the ink channel 108 may have an oval or polygonal section. The ink channel 108 may be formed parallel to a top surface of the substrate 100, and a plurality of ink channels 108 may be formed.

The nozzle plate 120 is disposed on the upper surface of the substrate 100 in which the ink chamber 106, the ink channel 108, and the manifold 110 are formed. The nozzle plate 120 forms an upper wall of the ink chamber 106. A nozzle 104 is formed at a position corresponding to a central portion of the ink chamber 106 and allows the ink to be ejected therethrough.

The nozzle plate 120 may be formed of a plurality of material layers stacked on the substrate 100. The material layers may include a first passivation layer 121, a second passivation layer 123, a third passivation layer 125, a heat dissipation layer 127, and an anti-corrosion layer 129. A heater 122 may be interposed between the first passivation layer 121 and the second passivation layer 123. A conductor 124 may be interposed between the second passivation layer 123 and the third passivation layer 125.

The first passivation layer 121 is the lowest layer of the material layers, which are components of the nozzle plate 120, and is formed on the upper surface of the substrate 100. The first passivation layer 121 provides insulation between the heater 122 and the substrate 100 and protects the heater 122. The first passivation layer 121 may be formed of silicon oxide or silicon nitride.

The heater 122, which heats ink filled in the ink chamber 106, is formed on the first passivation layer 121. The heater 122 may be made of a heating resistor, such as polysilicon doped with impurities, tantalum-aluminium alloy, tantalum nitride, titanium nitride, or tungsten silicide.

The second passivation layer 123 is formed on the heater 122. The second passivation layer 123 may be a silicon nitride layer or a silicon oxide layer, like the first passivation layer 121, to insulate the heat dissipation layer 127 from the heater 122 and protect the heater 122.

The conductor 124 is formed on the second passivation layer 123 and is electrically connected to the heater 122 to apply a current pulse to the heater 122. A first end of the conductor 124 is connected to the heater 122 through a contact hole, which passes through the second passivation layer 123. A second end of the conductor 124 is connected to bonding pads (not shown), which are arranged at both edges of the printhead. The conductor 124 may be made of a highly electrically conductive material, such as aluminum (Al), aluminum alloy, gold (Au), or silver (Ag).

The third passivation layer 125 is formed on the conductor 124. The third passivation layer 125 may be a tetraethylorthosilicate (TEOS) oxide layer, a silicon oxide layer, or a silicon nitride layer.

The heat dissipation layer 127 is formed on the third passivation layer 125. The heat dissipation layer 127 may include a first thermally conductive layer 127*a* and a second thermally conductive layer 127*b*, and dissipates heat, which is generated by the heater 122, out of the printhead.

The first thermally conductive layer 127*a* is formed on the third passivation layer 125 and may be inlaid with copper (Cu) using a copper damascening process. In the copper damascening process, a predetermined additive is added to a sulphurous acid copper plating solution to substantially flatten a copper layer. During the copper damascening process, a copper plating is first performed from a concave portion of the third passivation layer 125 and continues until the first thermally conductive layer 127*a* having a substantially flat top surface is formed. The first thermally conductive layer 127*a* may have a thickness ranging from about 1 to 12 μm. The thickness of the first thermally conductive layer may be less than a thickness of the second thermally conductive layer.

A seed layer 126 may be interposed between the third passivation layer 125 and the first thermally conductive layer 127*a* for use in plating the first thermally conductive layer 127*a*. The seed layer 126 may be made of a highly electrically conductive material, such as copper (Cu), chromium (Cr), titanium (Ti), gold (Au), or nickel (Ni).

The second thermally conductive layer 127*b* is formed on the first thermally conductive layer 127*a*. The second thermally conductive layer 127*b* may be made of a highly thermally conductive material, such as nickel (Ni), copper (Cu), aluminum (Al), or gold (Au). The second thermally conductive layer 127*b* may be formed on the first thermally conductive layer 127*a* by electrolytically plating the highly thermally conductive material at a high speed, so that the second thermally conductive layer 127*b* may have a relatively large thickness, i.e., greater than a thickness of the first thermally conductive layer 127*a*, ranging from about 10 to 100 μm. Since the second thermally conductive layer 127*b* is formed on the substantially flat top surface of the first thermally conductive layer 127*a* using the electrolytic plating process, the second thermally conductive layer 127*b* also has a substantially flat top surface. Accordingly, the nozzle plate 120 may be formed to have a substantially flat top surface.

Since the heat dissipation layer 127, including the first thermally conductive layer 127*a* and the second thermally conductive layer 127*b*, may be formed using the plating process, the heat dissipation layer 127 can be integrally formed with other elements of the ink-jet printhead. Since the heat dissipation layer 127 has a relatively large thickness, the nozzle 104 can be formed sufficiently long. Accordingly, a stable high speed printing can be accomplished and the linearity of ink droplets ejected through the nozzle 104 can be improved. That is, the ink droplets can be ejected exactly perpendicular to the substrate 100.

Meanwhile, the anti-corrosion layer 129 is formed over the heat dissipation layer 127. The anti-corrosion layer 129 prevents the heat dissipation layer 127, which is made of the highly thermally conductive material, from being corroded by ink. The anti-corrosion layer 129 may be made of a highly chemically-resistant and corrosion-resistant material, such as gold (Au), platinum (Pt), or palladium (Pd). The anti-corrosion layer 129 may be formed by electrolessly plating the highly chemically-resistant and corrosion-resistant material over the heat dissipation layer 127. The anti-corrosion layer 129 may have a thickness ranging from about 0.1 to 1 μm.

The nozzle 104 extends through the nozzle plate 120 and includes a lower nozzle 104*a* and an upper nozzle 104*b*. The lower nozzle 104*a* has a cylindrical shape which passes through the first, second, and third passivation layers 121, 123,125 of the nozzle plate 120. The upper nozzle 104*b* passes through the heat dissipation layer 127 that consists of the first thermally conductive layer 127*a* and the second thermally conductive layer 127*b*. The upper nozzle 104*b* may have a cylindrical shape or may have a tapered shape having a sectional area that decreases toward an outlet of the nozzle 104, as shown in FIG. 3. If the upper nozzle 104*b* is formed to have the tapered shape, a meniscus at a surface of ink in the nozzle 104 is more quickly stabilized after ink is ejected.

As previously described, since the first thermally conductive layer 127*a* of the heat dissipation layer 127 may be formed using the copper damascening process, the substantially flat nozzle plate 120 can be obtained. Accordingly, a chemical mechanical polishing (CMP) process for flattening the nozzle plate 120 is not required, thereby simplifying the manufacturing process of the ink-jet printhead.

A method of manufacturing an ink-jet printhead according to an embodiment of the present invention will now be described with reference to FIGS. 4 through 14.

FIGS. 4 through 14 illustrate cross-sectional views of stages in a method for manufacturing an ink-jet printhead according to an embodiment of the present invention.

Figure 4:
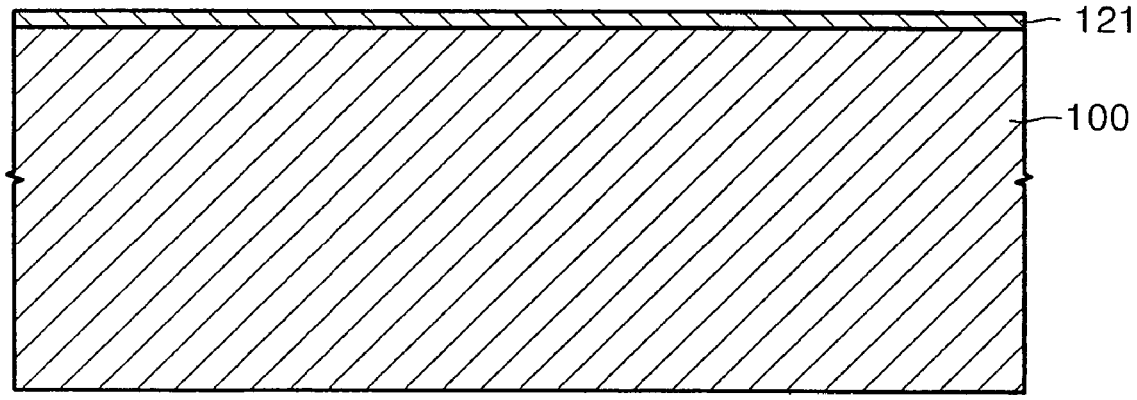
FIGS. 4 through 14 illustrate cross-sectional views for explaining stages in a method of manufacturing the monolithic ink-jet printhead shown in FIG. 3.

FIG. 4 illustrates a cross-sectional view of a stage in which the first passivation layer 121 is formed on the substrate 100.

Referring to FIG. 4, a silicon wafer is processed to have a thickness in a range of about 300 to 500 μm and is used as the substrate 100. Silicon wafers are widely used to manufacture semiconductor devices, and thus facilitate mass production of a printhead. Although only a small portion of the silicon wafer is shown in FIG. 4, an ink-jet printhead according to the present invention may be one of tens or hundreds of chips produced from a single wafer.

Next, the first passivation layer 121 is formed on the prepared silicon substrate 100. The first passivation layer 121 may be formed by depositing silicon oxide or silicon nitride on the substrate 100.

Figure 5:
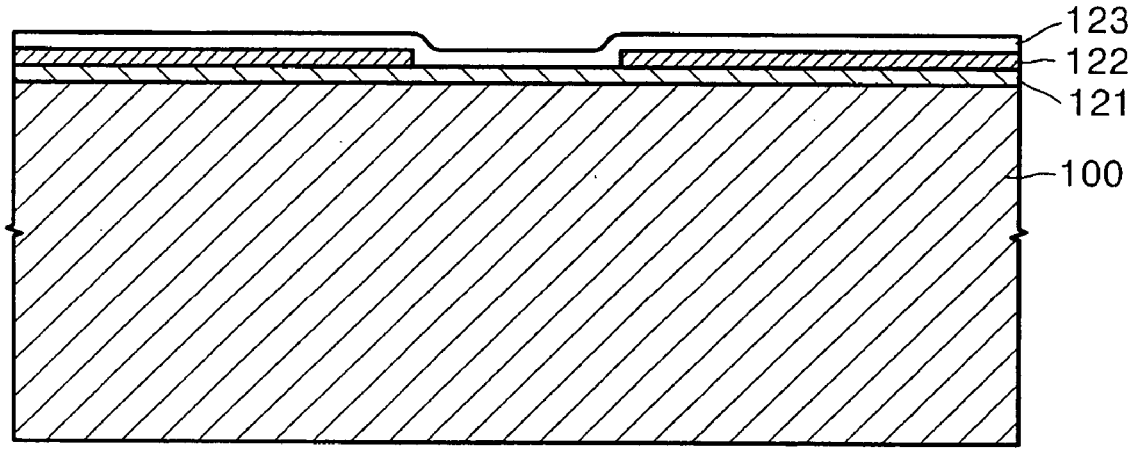

FIG. 5 illustrates a cross-sectional view of a stage in which the heater 122 is formed on the first passivation layer 121 and the second passivation layer 123 is formed on the first passivation layer 121 and the heater 122.

Referring to FIG. 5, the heater 122 is formed on the first passivation layer 121, which is formed on the substrate 100. The heater 122 may be formed by depositing a heating resistor, such as polysilicon doped with impurities, tantalum-aluminum alloy, or tantalum nitride, over the first passivation layer 121 to a predetermined thickness, and then patterning the deposited heating resistor. In particular, the heating resistor of polysilicon may be deposited to a thickness of approximately 0.7 to 1 μm using a source gas containing phosphorous as impurities using a low pressure chemical vapor deposition (LPCVD). The heating resistor of tantalum-aluminum alloy or tantalum nitride may be deposited to a thickness of approximately 0.1 to 0.3 μm using a sputtering process. The thickness of the deposited heating resistor varies to have an appropriate resistance in consideration of the width and length of the heater 122. The heating resistor deposited over the first passivation layer 121 can be patterned by a photolithography process using a photo mask and a photoresist and by an etching process using a photoresist pattern as an etching mask.

Next, the second passivation layer 123 is formed on the first passivation layer 121 and the heater 122. The second passivation layer 123 may be formed by depositing silicon oxide or silicon nitride to a thickness ranging from about 0.2 to 1 μm.

Figure 6:
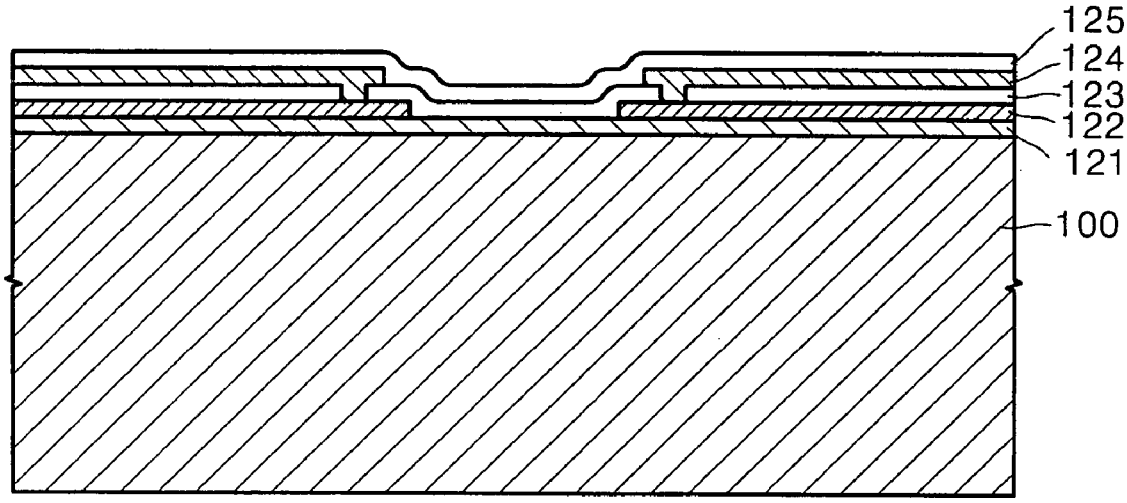

FIG. 6 illustrates a cross-sectional view of a stage in which the conductor 124 is formed on the second passivation layer 123 and the third passivation layer 125 is formed on the second passivation layer 123 and the conductor 124.

Referring to FIG. 6, a contact hole is formed by partially etching the second passivation layer 123 to expose a portion of the heater 122. The conductor 124 may be formed by depositing a highly electrically and thermally conductive material, such as aluminum (Al), aluminum alloy, gold (Au), or silver (Ag), over the second passivation layer 123 to a thickness ranging from about 0.5 to 2 μm using a sputtering process and patterning the deposited highly conductive material. The conductor 124 is connected to the heater 122 through the contact hole.

Next, the third passivation layer 125 is formed on the second passivation layer 124 and the conductor 124. The third passivation layer 125 may be formed by depositing TEOS oxide to a thickness ranging from about 0.7 to 3 μm using plasma enhanced chemical vapor deposition (PECVD).

Figure 7:
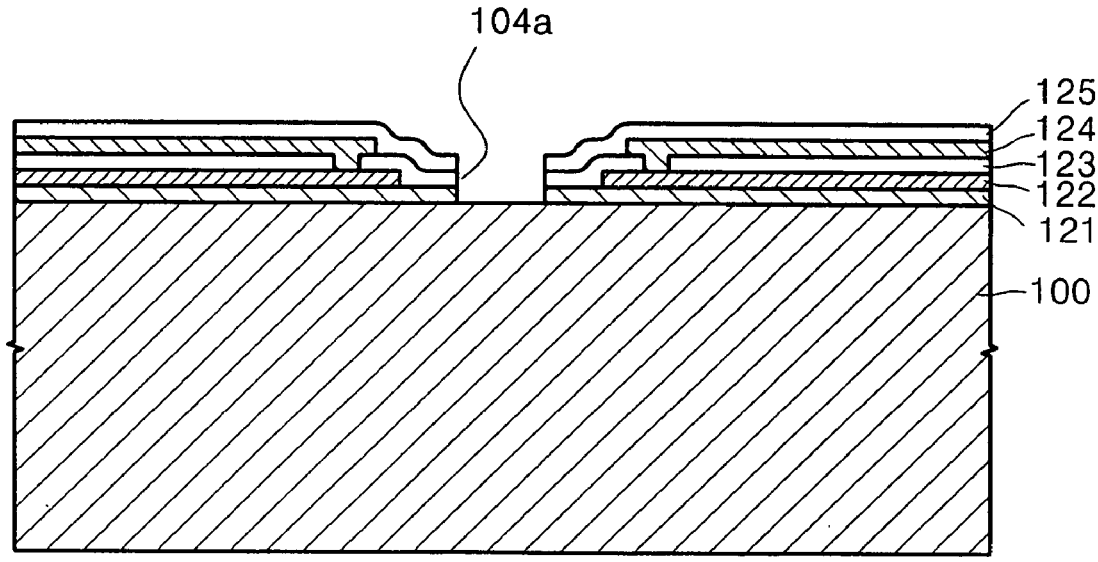

FIG. 7 illustrates a cross-sectional view of a stage in which the lower nozzle 104*a* is formed.

Referring to FIG. 7, the lower nozzle 104*a* is formed by sequentially etching the third passivation layer 125, the second passivation layer 123, and the first passivation layer 121 using reactive ion etching (RIE). A portion of the substrate 100 is exposed during the etching process.

Figure 8:
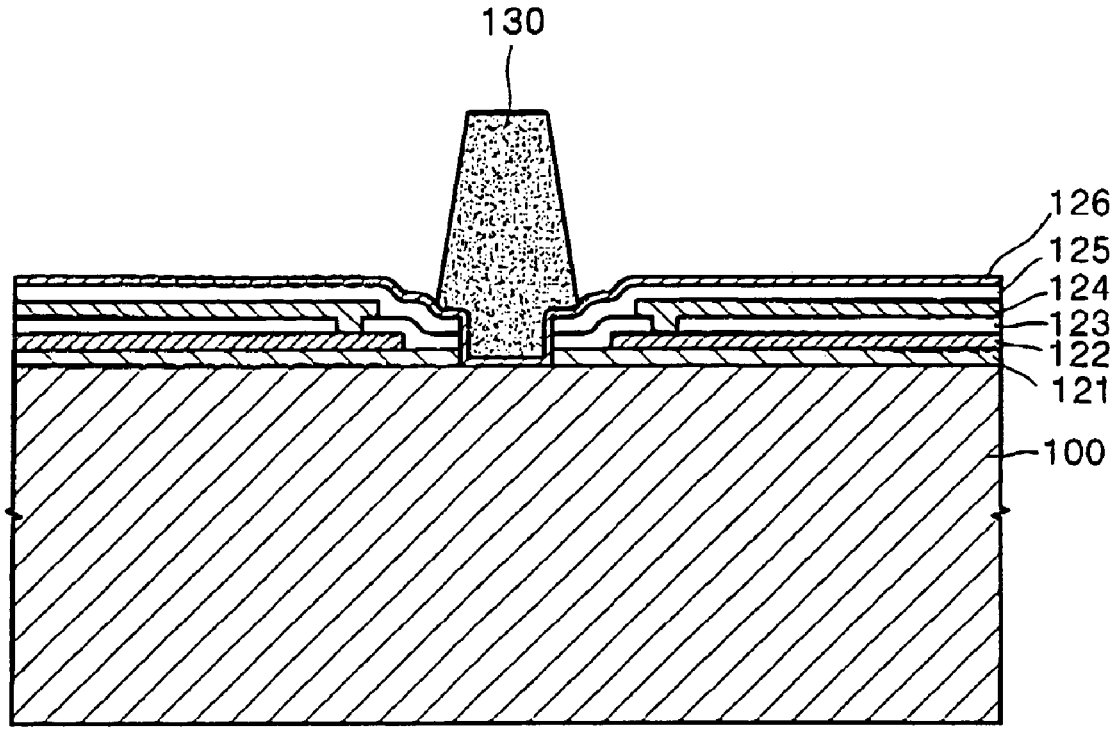

FIG. 8 illustrates a cross-sectional view of a stage in which the seed layer 126 is formed and the plating mold 130 is formed on the seed layer 126.

Referring to FIG. 8, the seed layer 126 is formed over the resultant structure of FIG. 7 to be used in performing an electrolytic plating process. The seed layer 126 may be formed by depositing a highly electrically conductive material, such as copper (Cu), chromium (Cr), titanium (Ti), gold (Au), or nickel (Ni), to a thickness ranging from about 500 to 3000 Å using a sputtering process.

Next, a plating mold 130 may be formed on the seed layer 126 to define the nozzle 104. The plating mold 130 may be formed by applying photoresist over the seed layer 126 and patterning the photoresist except at an area where the nozzle 104 is to be formed. In addition to being formed using photoresist, the plating mold 130 may be formed using a photosensitive polymer. Here, an upper portion of the plating mold 130 has a tapered shape having a cross-sectional area that decreases toward an outlet of the nozzle.

Figure 9:
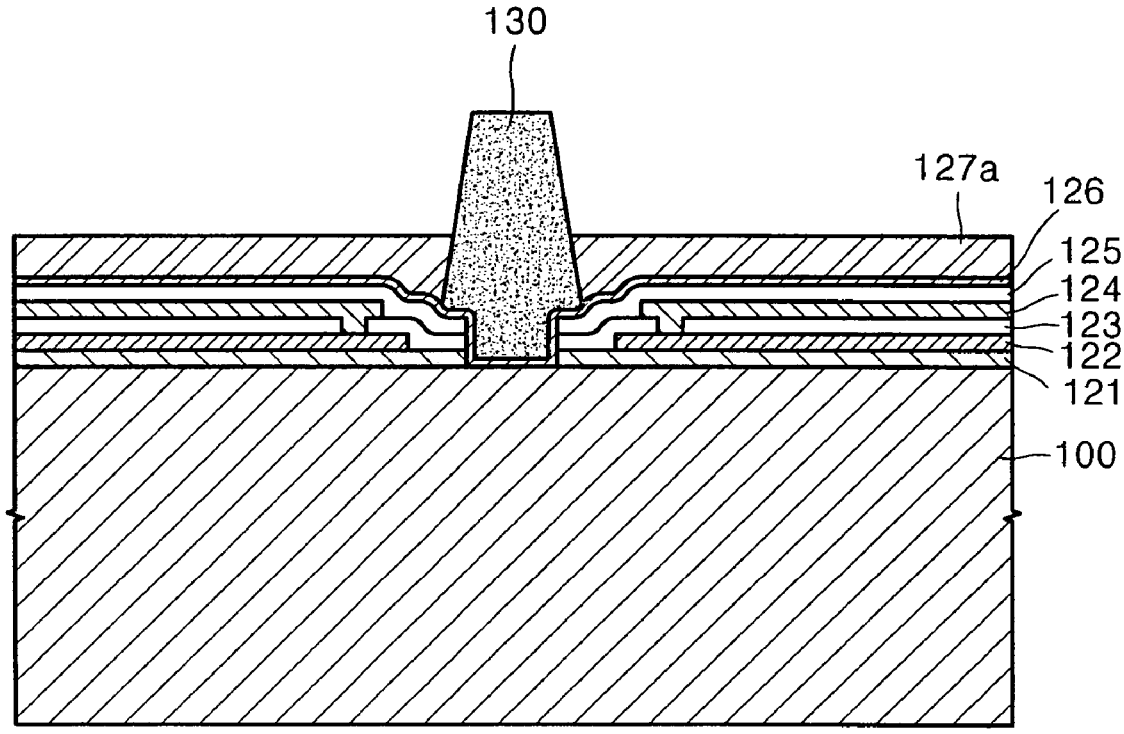

FIG. 9 illustrates a cross-sectional view of a stage in which the first thermally conductive layer 127*a*, i.e., the lower layer of the heat dissipation layer 127, is formed on the seed layer 126.

Referring to FIG. 9, the first thermally conductive layer 127*a* may be formed on the seed layer 126 using a copper damascening process. In the copper damascening process, a predetermined additive is added to a sulphurous acid copper plating solution to form a substantially flat copper layer on the seed layer 126, which has an uneven surface. That is, during the copper damascening process, a copper plating process is first performed from a concave portion of the seed layer 126 and continues until the plated copper layer is substantially flattened. Accordingly, the substantially flat first thermally conductive layer 127*a* is formed on the seed layer 126. The first thermally conductive layer 127*a* may have a thickness ranging from about 1 to 12 μm.

Figure 10:
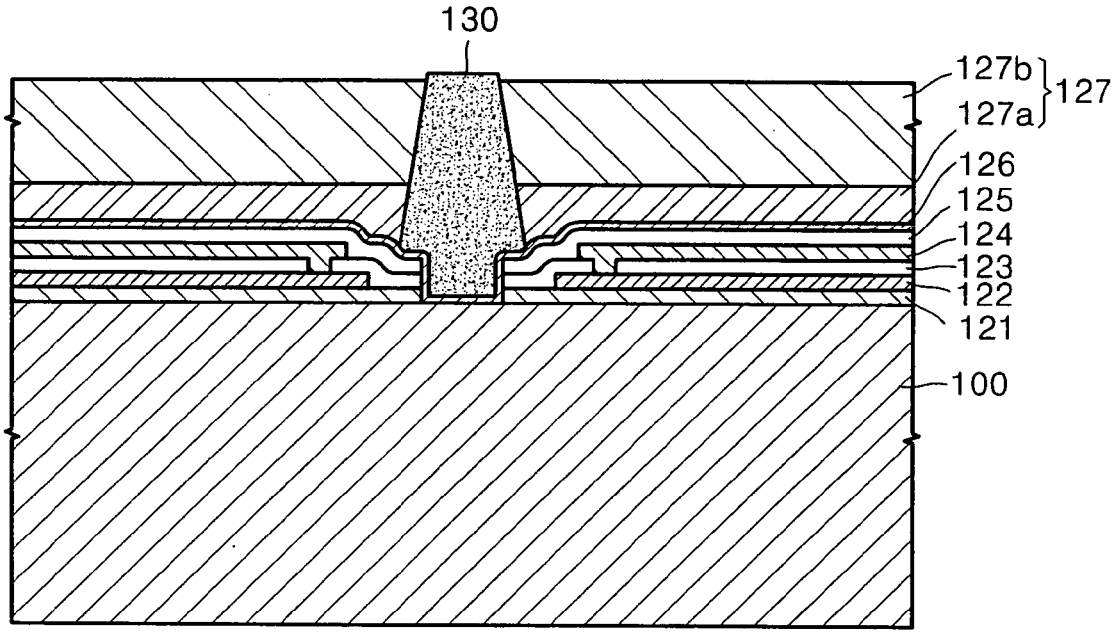

FIG. 10 illustrates a cross-sectional view of a stage in which the second thermally conductive layer 127*b*, i.e., the upper layer of the heat dissipation layer 127, is formed on the first thermally conductive layer 127*a*.

Referring to FIG. 10, the second thermally conductive layer 127*b* may be formed by electrolytically plating a highly thermally conductive material, such as nickel (Ni), copper (Cu), aluminum (Al), or gold (Au), on the first thermally conductive layer 127*a*. The second thermally conductive layer 127*b* may be formed at a higher speed than the first thermally conductive layer 127*a*, and may have a thickness ranging from about 10 to 100 μm.

Because the second thermally conductive layer 127*b* is formed on the substantially flat top surface of the first thermally conductive layer 127*a* using the electrolytic plating process, the second thermally conductive layer 127*b* also has a substantially flat top surface.

Figure 11:
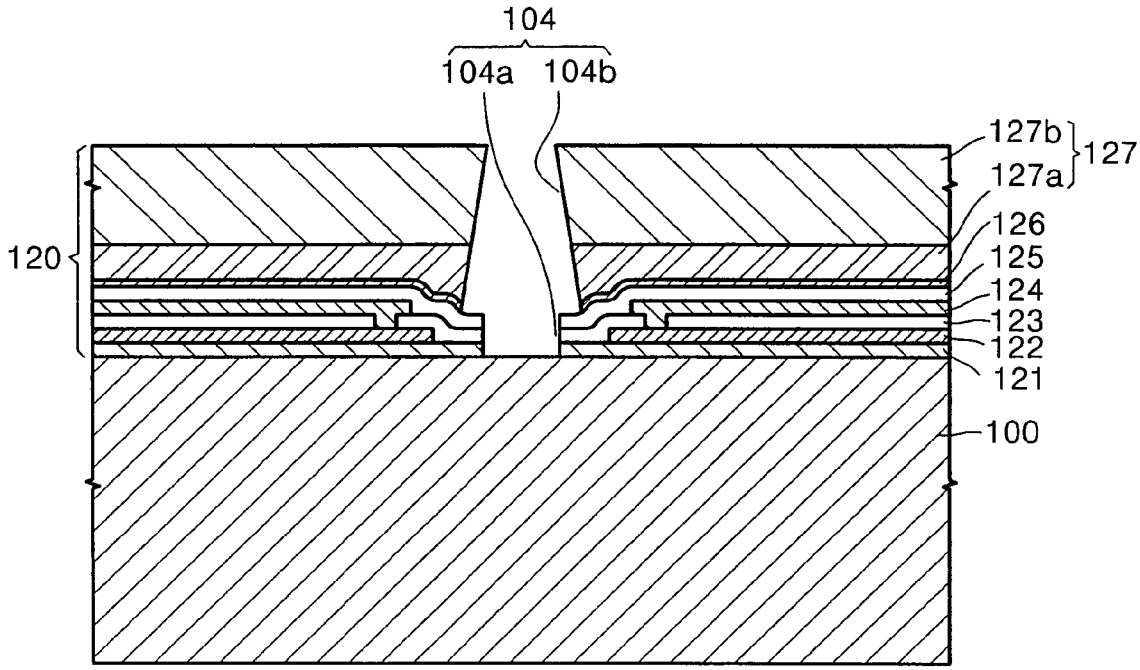

FIG. 11 illustrates a cross-sectional view of a stage in which the nozzle 104 is formed in the nozzle plate 120.

Referring to FIG. 11, the plating mold 130 and the seed layer 126 are sequentially removed. The plating mold 130 may be removed by a typical method of removing photoresist. The seed layer 126 may be wet etched using an etchant that can selectively etch only the seed layer 126 in consideration of an etching selectivity between the highly thermally conductive material of the heat dissipation layer 127 and the highly electrically conductive material of the seed layer 126. Through this, the nozzle 104 including the lower nozzle 104*a* and the upper nozzle 104*b* is formed and the nozzle plate 120, including the plurality of stacked material layers, is completed. A portion of the substrate 100, on which the ink chamber 106 is to be formed, is exposed through the nozzle 104.

Figure 12:
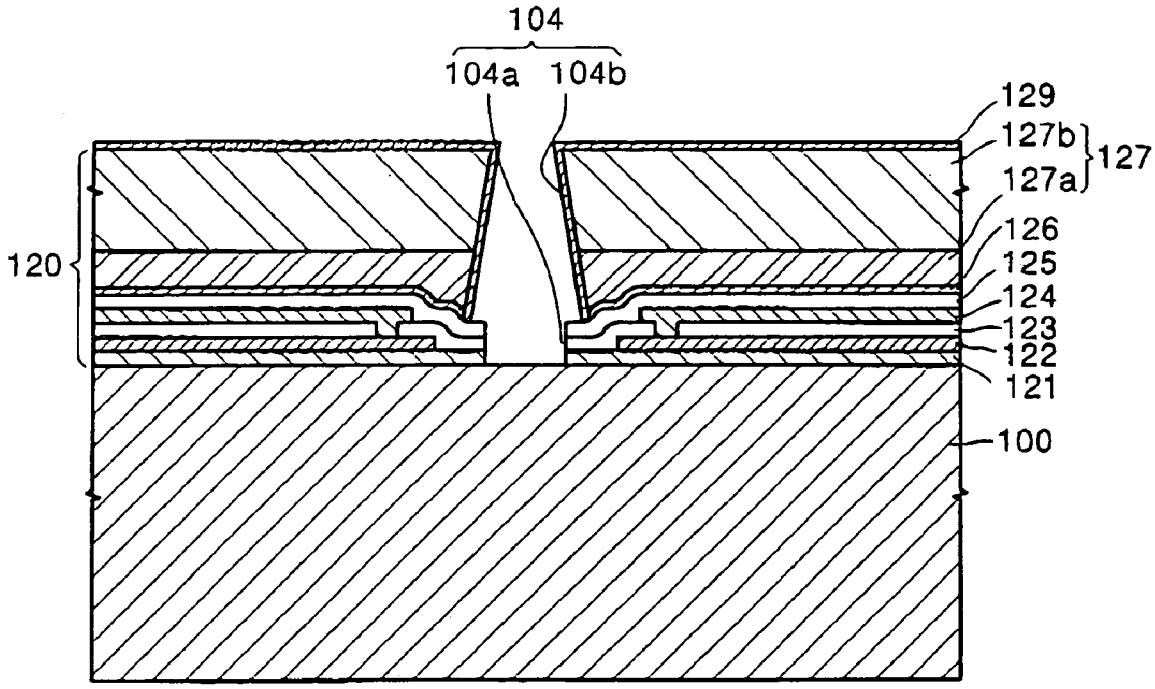

FIG. 12 illustrates a cross-sectional view of a stage in which the anti-corrosion layer 129 is formed over the heat dissipation layer 127.

Referring to FIG. 12, the anti-corrosion layer 129 may be formed by electrolessly plating a highly chemically-resistant and corrosion-resistant material, such as gold (Au), platinum (Pt), or palladium (Pd), over the heat dissipation layer 127 including the first and second thermally conductive layers 127*a* and 127*b*. The anti-corrosion layer 129 may have a thickness ranging from about 0.1 to 1 μm.

Figure 13:
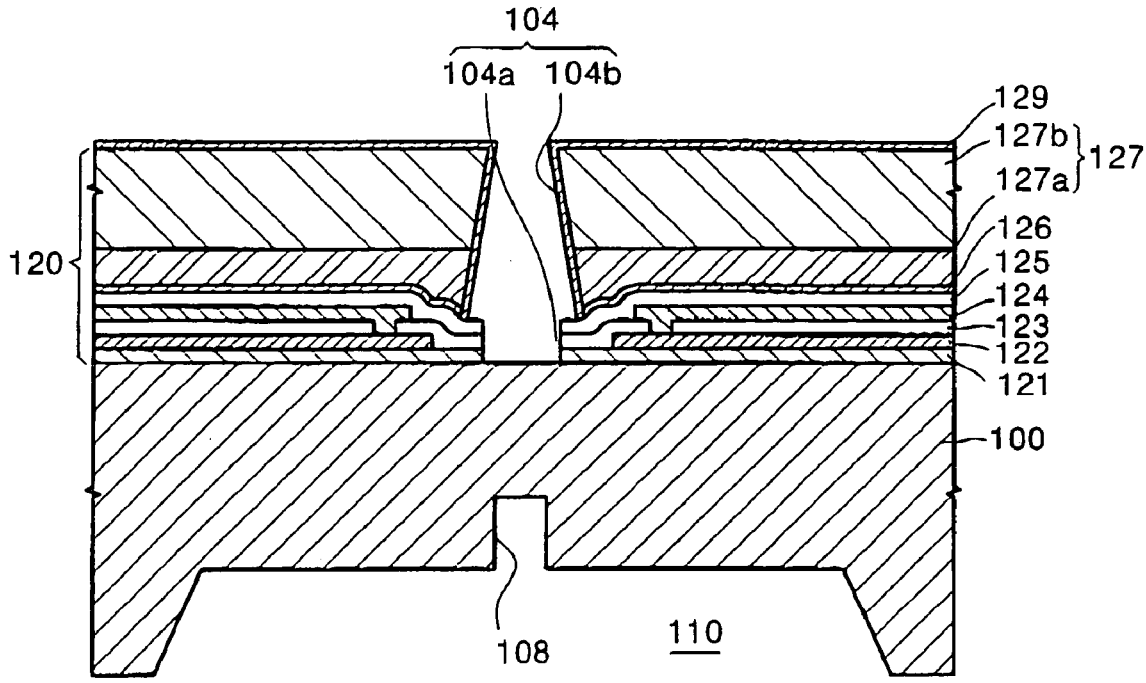

FIG. 13 illustrates a cross-sectional view of a stage in which the manifold 110 and the ink channel 108 are formed in the substrate 100.

Referring to FIG. 13, the manifold 110 is formed on a lower surface of the substrate 100. Specifically, after an etching mask, which defines an etched area, is formed on the lower surface of the substrate 100, the lower surface of the substrate 100 may be wet etched using an alkali anisotropic etchant, such as tetramethyl ammonium hydroxide (TMAH), to form the manifold 110 having inclined lateral surfaces. Alternatively, the manifold 110 may be formed by anisotropically dry etching the lower portion of the substrate 100. Next, an etching mask, which defines the ink channel 108, is formed on the lower surface of the substrate 100, in which the manifold 110 is formed, and then, the lower surface of the substrate 100 is dry etched by RIE to form the ink channel 108.

Figure 14:
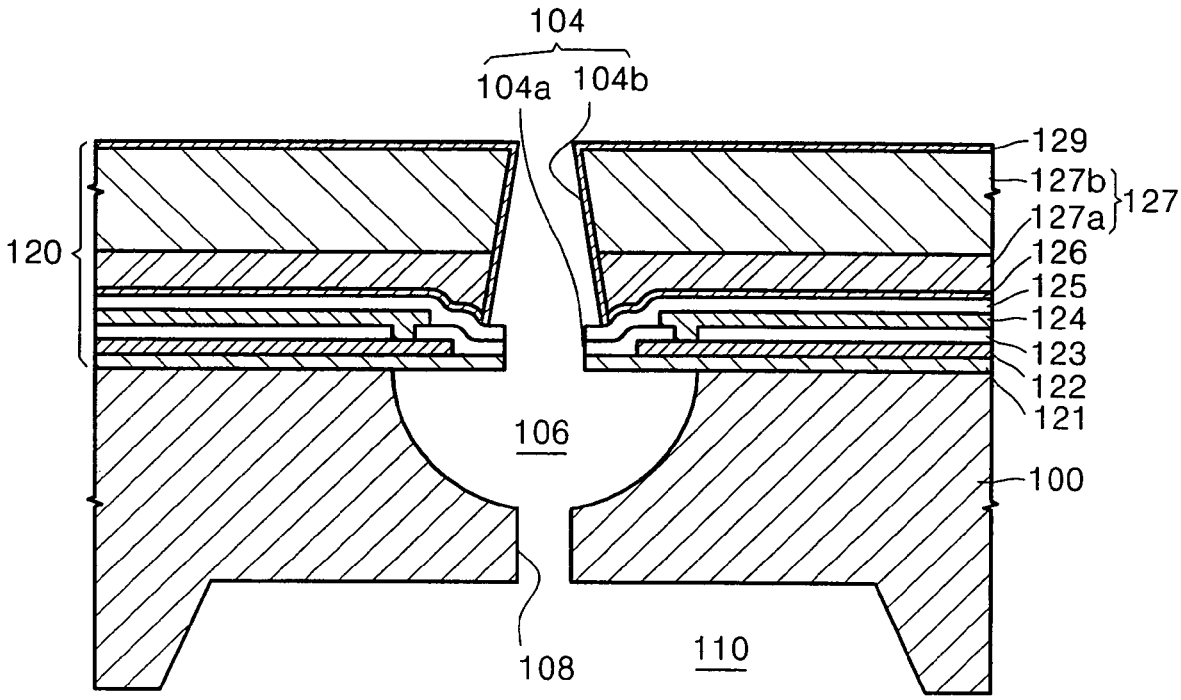

FIG. 14 illustrates a cross-sectional view of a stage in which the ink chamber 106 is formed in the substrate 100.

Referring to FIG. 14, the ink chamber 106 in flow communication with the ink channel 108 is formed on an upper surface of the substrate 100. The ink chamber 106 may be formed by isotropically etching the portion of the substrate 100, which is exposed by the nozzle 104. Specifically, the portion of the substrate 100 may be dry etched for a predetermined period of time using an $XeF_2$ gas or $BrF_3$ gas as an etching gas to form the substantially hemispherical ink chamber 106.

Alternatively, in an ink-jet printhead according to various alternate embodiments of the present invention, the ink chamber 106 and the ink channel 108 may have various shapes according to the etched shape of the substrate 100. For example, the ink chamber 106 may have a rectangular shape of a predetermined depth, and the ink channel 108 may have an oval or polygonal section. The ink channel 108 may be formed in parallel to the surface of the substrate 100, and a plurality of ink channels may be formed.

As described above, the ink-jet printhead and the method of manufacturing the ink-jet printhead according to an embodiment of the present invention may have one or more of the following advantages.

First, since heat dissipation characteristics are improved by the heat dissipation layer made of a thick, highly thermally conductive material, ink ejecting characteristics and an operating frequency may be improved, and a printing error or damage to the heater due to overheating may be prevented, even during a high speed printing process.

Second, since a nozzle having a sufficient length can be provided because of the thickness of the heat dissipation layer, the linearity of the ejected ink droplets may be enhanced.

Third, since the nozzle plate may be integrally formed with the substrate, a process of bonding the nozzle plate to the substrate is not required and misalignment between the ink chamber and the nozzle may be prevented.

Fourth, since a substantially flat nozzle plate may be obtained using a copper damascening process, a typically needed CMP process may be omitted, thereby simplifying the method of manufacturing the ink-jet printhead. Moreover, the possibility of non-uniformity occurring at the outlet of the nozzle due to the CMP process is reduced, thereby increasing the yield of the ink-jet printhead.

Fifth, since the anti-corrosion layer, which is formed on the heat dissipation layer, using the electroless plating process, the nozzle plate is prevented from being corroded, thereby extending a lifespan of the ink-jet printhead.

Exemplary embodiments of the present invention have been disclosed herein and, although specific terms are employed, they are used and are to be interpreted in a generic and descriptive sense only and not for purpose of limitation. For example, each element of the ink-jet printhead may be made of a material other than those mentioned. That is, the substrate can be made of a material with high processability other than silicon, and the heater, the conductor, the passivation layers, and the heat dissipation layer can be made of other materials than listed above. Furthermore, the method of depositing and forming the materials are just exemplary, and thus various deposition and etching methods can be used. The specific figures suggested in each step are variable within a range where the manufactured ink-jet printhead can normally operate. Accordingly, it will be understood by those of ordinary skill in the art that various changes in form and details may be made without departing from the spirit and scope of the present invention as set forth in the following claims.

What is claimed is:

1. An ink-jet printhead, comprising:

a substrate, an ink chamber to be filled with ink to be ejected formed on an upper surface of the substrate, a manifold for supplying ink to the ink chamber formed on a lower surface of the substrate, and an ink channel formed between the ink chamber and the manifold to provide flow communication between the ink chamber and the manifold;

a substantially flat nozzle plate formed on the upper surface of the substrate, the nozzle plate including a plurality of passivation layers, a heat dissipation layer disposed on the plurality of passivation layers, the heat dissipation layer formed of a thermally conductive material and including a first thermally conductive layer formed on the plurality of passivation layers and a second thermally conductive layer formed on the first thermally conductive layer, and a nozzle extending through the nozzle plate in flow communication with the ink chamber; and a heater and a conductor, each of which is interposed between adjacent passivation layers of the nozzle plate, the heater heating ink filled in the ink chamber and the conductor applying current to the heater.

2. The ink-jet printhead as claimed in claim 1, wherein the first thermally conductive layer includes copper (Cu).

3. The ink-jet printhead as claimed in claim 1, wherein the first thermally conductive layer has a substantially flat top surface.

4. The ink-jet printhead as claimed in claim 1, wherein a thickness of the first thermally conductive layer is between about 1 to 12 μm.

5. The ink-jet printhead as claimed in claim 1, wherein the second thermally conductive layer is made of a material selected from the group consisting of nickel (Ni), copper (Cu), aluminum (Al), and gold (Au).

6. The ink-jet printhead as claimed in claim 1, wherein a thickness of the first thermally conductive layer is less than a thickness of the second thermally conductive layer.

7. The ink-jet printhead as claimed in claim 1, further comprising an anti-corrosion layer formed over the heat dissipation layer to prevent the heat dissipation layer from being corroded by ink.

8. The ink-jet printhead as claimed in claim 7, wherein the anti-corrosion layer is made of a material selected from the group consisting of gold (Au), platinum (Pt), and palladium (Pd).

9. The ink-jet printhead as claimed in claim 7, wherein a thickness of the anti-corrosion layer is between about 0.1 to 1 μm.

10. The ink-jet printhead as claimed in claim 1, further comprising a seed layer formed between the plurality of passivation layers and the first thermally conductive layer to be used in plating the first thermally conductive layer.

11. The ink-jet printhead as claimed in claim 10, wherein the seed layer is made of a material selected from the group consisting of copper (Cu), chromium (Cr), titanium (Ti), gold (Au), and nickel (Ni).

12. The ink-jet printhead as claimed in claim 1, wherein the plurality of passivation layers comprises a first passivation layer, a second passivation layer, and a third passivation layer, which are sequentially stacked on the substrate, and wherein the heater is interposed between the first passivation layer and the second passivation layer, and the conductor is interposed between the second passivation layer and the third passivation layer.

13. The ink-jet printhead as claimed in claim 1, wherein a lower portion of the nozzle is formed in the plurality of passivation layers and an upper portion of the nozzle is formed in the heat dissipation layer.

14. The ink-jet printhead as claimed in claim 13, wherein the upper portion of the nozzle formed in the heat dissipation layer has a tapered shape having a sectional area that decreases toward an outlet of the nozzle.

* * * * *